US012480683B1

(12) United States Patent
Villarreal

(10) Patent No.: US 12,480,683 B1
(45) Date of Patent: Nov. 25, 2025

(54) VENTILATION SYSTEM FOR PROVIDING FRESH AIR INTO BUILDINGS

(71) Applicant: Silvia Villarreal, San Antonio, TX (US)

(72) Inventor: Silvia Villarreal, San Antonio, TX (US)

( * ) Notice: Subject to any disclaimer, the term of this patent is extended or adjusted under 35 U.S.C. 154(b) by 0 days.

(21) Appl. No.: 18/910,788

(22) Filed: Oct. 9, 2024

(51) Int. Cl.
*F24F 13/08* (2006.01)

(52) U.S. Cl.
CPC ..... *F24F 13/08* (2013.01)

(58) Field of Classification Search
CPC ..... F24F 13/08; F24F 2013/088; F24F 13/10; F24F 13/14; F24F 13/1426; F24F 2013/1473; F24F 13/1486; F24F 13/18; F24F 13/15; F24F 13/224; F24F 13/26; F24F 13/32; F24F 11/745; F24F 11/79; F24F 11/84
USPC ..... 454/284
See application file for complete search history.

(56) References Cited

U.S. PATENT DOCUMENTS

| | | | | |
|---|---|---|---|---|
| 345,689 | A | 7/1886 | Hayes | |
| 793,403 | A | 6/1905 | Taylor | |
| 884,052 | A | 4/1908 | Taylor | |
| 1,052,812 | A | 2/1913 | Garland | |
| 1,467,005 | A | 9/1923 | Lawrence | |
| 1,616,297 | A | 2/1927 | Alber | |
| 1,838,207 | A | 12/1931 | Allen | |
| 1,872,599 | A | 8/1932 | Le Grand | |
| 2,191,774 | A | 2/1940 | Reed | |
| 5,120,273 | A | 6/1992 | Lin | |
| 7,497,774 | B2 | 3/2009 | Stevenson et al. | |
| 11,781,762 | B1 | 10/2023 | Stevenson | |
| 12,025,336 | B1 * | 7/2024 | Galvin | F24F 13/1426 |
| 2008/0242215 | A1 * | 10/2008 | Pagenstert | F24F 13/14 454/284 |
| 2017/0082316 | A1 * | 3/2017 | Miller | F24F 13/084 |

FOREIGN PATENT DOCUMENTS

| | | |
|---|---|---|
| AU | 2017/202404 | 3/2023 |
| CA | 3020159 | 7/2023 |
| KR | 200440195 Y1 | 5/2008 |

* cited by examiner

*Primary Examiner* — Avinash A Savani
*Assistant Examiner* — Ryan L Faulkner
(74) *Attorney, Agent, or Firm* — NORTON ROSE FULBRIGHT US LLP

(57) ABSTRACT

The present disclosure includes an air guide assembly for cooling the inside of a building or refreshing the air inside of a building. The air guide assembly may be operatively coupled around, near, or at the opening of a building. In some aspects, the air guide assembly includes a body configured for re-directing an air current, a frame for supporting the body, a mounting device for supporting the frame and/or body, and an articulation member for positioning the body at a suitable angle for re-directing an air current into the building, or a combination thereof. In addition, methods of cooling the inside of a building or refreshing the air inside a building using an air guide assembly disclosed herein are described.

10 Claims, 8 Drawing Sheets

VENTILATION SYSTEM FOR PROVIDING FRESH AIR INTO BUILDINGS

BACKGROUND OF THE INVENTION

I. Field of the Invention

The invention is directed to a ventilation system, and more particularly to an air guide assembly.

II. Background

Year-to-year increases in global temperatures are resulting in longer and hotter summers. In the hottest regions of the globe, extreme temperatures pose a health and safety risk for those without cooling means. According to the Centers for Disease Control and Prevention of the U.S.A., 119,605 heat-related illness emergency department visits were recorded in 2023 (Vaidyanathan A, Gates A, Brown C, Prezzato E, Bernstein A. Heat-Related Emergency Department Visits—United States, May-September 2023. MMWR Morb Mortal Wkly Rep 2024; 73:324-329). It is estimated that heat-related hospitalizations cost the U.S.A. approximately $1 billion in health-care costs every summer (Woolf S, Morina J, French E, Funk A, Sabo R, Fong S, Hoffman J, Chapman D, Krist A. The Health Care Costs of Extreme Heat. Center for American Progress. 27 Jun. 2023).

Current means to combat over-heating are expensive, inaccessible, or insufficient. Although air conditioning can mitigate heat-related illness events, it is the most expensive and inaccessible option. Thus, new, affordable, versatile, and effective systems or methods to cool buildings are needed.

SUMMARY

Aspects of the present disclosure describe methods, systems, and apparatuses for cooling a building or redirecting air into a building. For example, the present disclosure describes one or more assemblies configured to increase airflow into a building. To illustrate, an assembly may include a body having a surface configured to deflect an air current into an opening of a building, the surface of the body being angularly disposed relative to the opening at an angle suitable to deflect air currents into the building. The assembly may further comprise a frame operatively coupled to the body. The assembly may be operatively coupled to the outside of a building at, near, or around an opening.

In certain aspects, a surface of the body is angularly disposed relative to the opening of a building between about 20° to 80°. In some aspects, the surface is angularly disposed relative to the opening of a building at about 45°. In certain aspects, the body of the assembly comprises plastic, metal, or glass. In some aspects, the body is translucent. In some aspects, the body comprises a concave surface. In some aspects, the body defines a cavity. In some aspects, a horizontal cross-section of the body has a polygonal, pyriform, or oval shape.

In some aspects, a frame and/or body comprise a mounting device configured to operatively couple the assembly to a building. In some aspects, an assembly comprises an articulation member configured to allow movement of the body relative to the opening.

Aspects of the present disclosure describe methods for cooling the inside of a building and/or redirecting an air current into a building. In some aspects, a method comprises the steps of operatively coupling an air guide assembly of the disclosure to a portion of a building defining an opening, the air guide assembly including: a frame; and a body operatively coupled to the frame, the body having a first surface configured to direct air into the opening; and positioning the first surface of the body relative to the opening at a first angle between about 20° to 80°. In some aspects, the first angle is about 45°. In some aspects, the method comprises determining the direction of flow of an air current; and based on the direction of the air current, rotating the first surface to a second angle relative to the opening that is distinct from the first angle; and wherein the air flow into the opening is greater while the first surface is disposed at the second angle than the first angle. In some aspects, the second angle is between about 20° to 80°. In some aspects, a body is operatively coupled to an articulation member to allow adjustment of the position of the body and/or a surface of the body relative to an opening. In some aspects, the method further comprises readjusting and/or rotating the first surface by moving a rod operatively coupled to the body, the rod extending into the opening of the building. In some aspects, the body includes a second surface angularly disposed relative to the opening at a third angle; the third angle being substantially equal to and opposite of the first angle. In some aspects, the body comprises: a first surface disposed relative to the opening at a first angle; a second surface disposed relative to the opening at a second angle; and a third surface disposed relative to the opening at a third angle; wherein the first angle is greater than the second angle, and the second angle is greater than third angle. In some aspects, the first, second, or third angle may be between about 20° to 80°. In some aspects, the second surface is further from the opening than is the first surface; and the third surface is further from the opening that is the second surface. In some aspects, the first surface is operatively coupled to the second surface, and the second surface is operatively coupled to the third surface. In some aspects, operatively coupling the assembly to the building comprises attaching a side of the assembly to an exterior surface of a building by means of a mounting device.

The term "coupled" is defined as connected, although not necessarily directly, and not necessarily mechanically; two items that are "coupled" may be unitary with each other. The term "operatively coupled" is used to refer to components that are connected in a way to perform a designated function, that is the components have a functional relationship or are functionally cooperating with each other.

The terms "a" and "an" are defined as one or more unless this disclosure explicitly requires otherwise.

The term "substantially" or "approximately" is defined as largely but not necessarily wholly what is specified (and includes what is specified; e.g., substantially 90 degrees includes 90 degrees and substantially parallel includes parallel), as understood by a person of ordinary skill in the art. In any disclosed configuration, the term "substantially" may be substituted with "within [a percentage] of" what is specified, where the percentage includes 0.1, 1.0, 5.0, and 10.0 percent. The term "about" as used herein can allow for a degree of variability in a value or range, for example, within 10%, within 5%, or within 1% of a stated value or of a stated limit of a range and includes the exact stated value or range. Throughout this document, values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "about 0.1% to about 5%" or "about 0.1% to 5%" should be interpreted to include not just about 0.1% to about 5%, but also the individual values (e.g., 1%, 2%, 3%, and 4%) and the sub-ranges (e.g., 0.1% to 0.5%, 1.1% to 2.2%, 3.3% to 4.4%) within the indicated range.

As used herein, an ordinal term (e.g., "first," "second," "third," etc.) used to modify an element, such as a structure, a component, an operation, etc., does not by itself indicate any priority or order of the element with respect to another element, but rather merely distinguishes the element from another element having a same name (but for use of the ordinal term).

The terms "comprise" (and any form of comprise, such as "comprises" and "comprising"), "have" (and any form of have, such as "has" and "having"), and "include" (and any form of include, such as "includes" and "including") are open-ended linking verbs. As a result, an apparatus or assembly that "comprises," "has," or "includes" one or more elements possesses those one or more elements, but is not limited to possessing only those elements. Likewise, a method that "comprises," "has," or "includes" one or more steps possesses those one or more steps, but is not limited to possessing only those one or more steps.

As used herein, "or" is inclusive and not exclusive, unless expressly indicated otherwise or indicated otherwise by context, and can have the same meaning as "and/or."

Any configuration of any of the apparatuses, assemblies, systems, and methods can consist of or consist essentially of—rather than comprise/include/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

A feature or features of one configuration may be applied to other configurations, even though not described or illustrated, unless expressly prohibited by this disclosure or the nature of the configurations. Further, an apparatus or system that is configured in a certain way is configured in at least that way, but it can also be configured in other ways than those specifically described.

Some details associated with the configurations described above and others are described below.

Other objects, features and advantages of the present invention will become apparent from the following detailed description. It should be understood, however, that the detailed description, while indicating specific aspects of the invention, is given by way of illustration only, since various changes and modifications within the spirit and scope of the invention will become apparent to those skilled in the art from this detailed description.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific aspects presented herein.

DETAILED DESCRIPTION

Figure 1A:
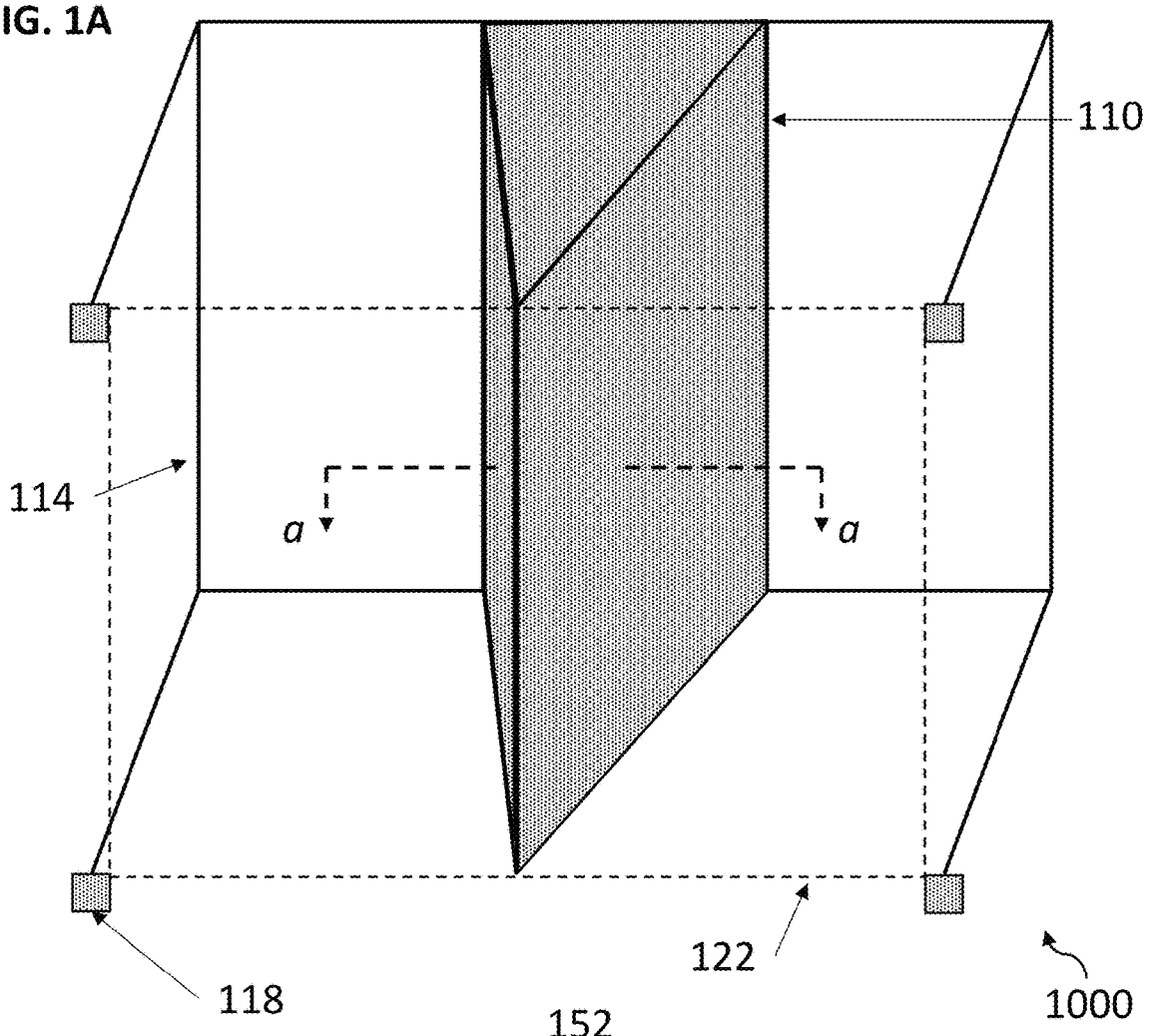
FIG. 1A is a frontal perspective view of an illustrative air guide assembly of the present disclosure.
Figure 1B:
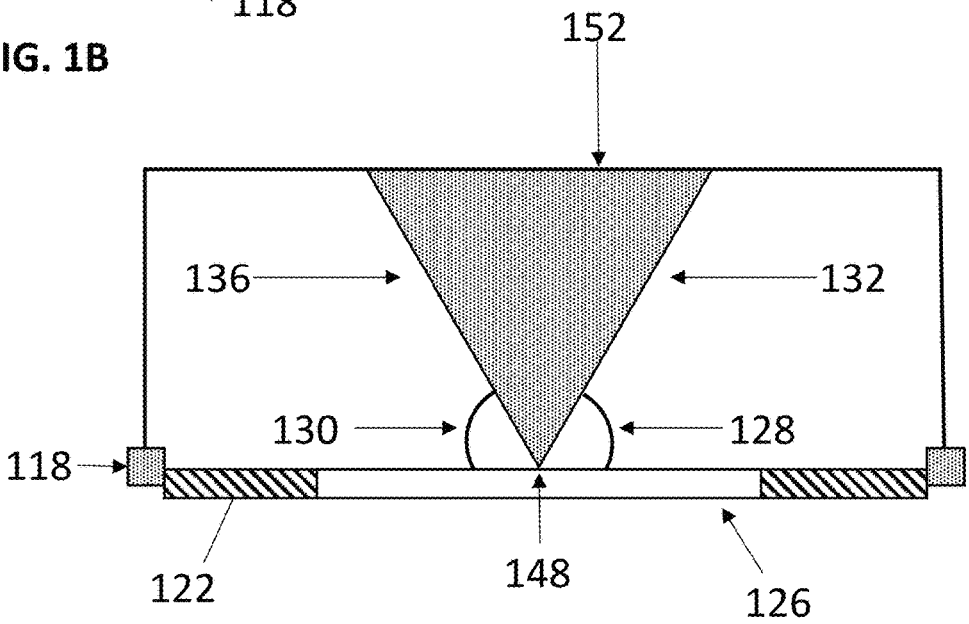
FIG. 1B shows a cross-section of the air guide assembly taken on the line a-a from FIG. 1A.

Referring to FIGS. 1A-1B, an illustrative air guide assembly 1000 is shown that includes a body 110 and a frame 114 operatively coupled to the body. Frame 114 is configured to mount the body adjacent to a building 122 and, in some configurations, the frame may include or be coupled to a mounting device 118 that may be attached directly or indirectly to the building, as best shown in FIG. 1B. In some configurations, frame 114 is coupled to one or more mounting devices 118. Frame 114 may be coupled to building 122 so that body 110 can be positioned adjacent to an opening 126, defined by building 122, to increase the airflow into opening 126.

As shown, body 110 can include a first end 148 and a second end 152 that is opposite the first end. Body 110 may be coupled to building 122 in such a way that first end 148 of the body is nearest to opening 126 than second end 152. Second end 152 can have a maximum transverse dimension (e.g., width) that is greater than a maximum transverse dimension of first end 148. For example, in some embodiments, such as the embodiment shown in FIG. 1B, first end 148 can correspond to a corner (e.g., intersection of two faces) of body 110 and second end 152 can correspond to a face of the body. In some configurations, a center of body 110 (e.g., centerline intersecting first end 148) can be aligned with a center of opening 126; however, in other configurations the center of body 110 can be offset from opening 126. In some configurations, body 110 can be movable relative to frame 114 in a lateral direction such that the body can be moved from a centered position to an offset position.

Body 110 can include one or more wind directing surfaces, such as first surface 132 and second surface 136 that are shaped to direct air into opening 126. The wind directing surfaces can extend from first end 148 to second end 152 of body 110. As depicted in the cross-section of body 110 shown in FIG. 1B, the body can have a triangular cross-sectional shape. In some configurations, first surface 132, second surface 136, or both are angularly disposed relative to opening 126 at an angle 128 and 130, respectively, such that an air current is directed into opening 126. Angle 128 or 130 may be substantially greater than or equal to 15 degrees, such as for example, substantially 15, 20, 25, 30, 35, 40, 45, 50, 55, 60, 65, 70, 75, or 80 degrees (e.g., between 30 and 60 degrees, such as 45 degrees), or any value therebetween. In some configurations, angles 128 and 130 are substantially equal. In other configurations, angle 128 can be greater or less than angle 130.

In some configurations, body 110 can have a height that is substantially greater than or equal to 0.3 meters (m), such as for example, substantially 0.3, 0.5, 1.0, 1.5, 2.0, 2.5, 3.0, 3.5, 4.0 m or any value therebetween. In some configurations, first surface 132, second surface 136, or both can have a height that is equal to the height of body 110. As shown, the height of first surface 132 or second surface 136 is uniform, but in other configurations the height of these surfaces can vary (e.g., higher or lower nearer first end 148 than second end 152). In some configurations, body 110 can have a maximum transverse dimension (e.g., width) that is substantially greater than or equal to 10 centimeters (cm), such as for example, substantially 10, 15, 20, 25, 30, 35, 40, 45, 50, 55, 60, 65, 70, 75, 80, 85, 90, 95, 100 cm, or any value therebetween. In some configurations, the maximum transverse dimension of body 110 may occur at second end 152. Body 110 can include a length (e.g., a distance between first surface 132 and second surface 136) that is substantially greater or equal to 10 cm, such as for example, substantially 10, 15, 20, 25, 30, 35, 40, 45, 50, 55, 60, 65, 70, 75, 80, 85, 90, 95, 100 cm, or any value therebetween. The length of body 110 may be, but need not be, different than the maximum transverse dimension of the body. In some configurations, a surface area of first surface 132, second surface 136, or both, can be substantially greater than or equal to 0.3 $m^2$, such as for example, substantially 0.3, 0.5, 1.0, 1.5, 2.0, 2.5, 3.0, 3.5, 4.0 $m^2$, or any value therebetween.

As shown in FIGS. 1A-1B, first surface 132 or second surface 136 can correspond to a side or face of the body. For example, in configurations in which the body is a right triangular prism, first surface 132 and second surface 136 correspond to a rectangular face. In some configurations, the height of first end 148 can be substantially greater than or equal to the height of opening 126. In other configurations, a wind directing surface (e.g., surface 132, or surface 136) can include multiple facets each disposed at different angles (e.g., angle 128, or angle 130) relative to opening 126, wherein the angle of each facet can be substantially greater than or equal to 15 degrees, such as for example, substantially 15, 20, 25, 30, 35, 40, 45, 50, 55, 60, 65, 70, 75, 80 degrees, or any value therebetween. As described above, a width of first end 148 can be less than the width of second end 152. In some configurations, the width of first end 148 can be substantially equal to 0.1-10% of the width of second end 152, such as for example, 0.1, 0.5, 1.0, 1.5, 2.0, 2.5, 3.0, 3.5, 4.0, 4.5, 5.0, 5.5, 6.0, 6.5, 7.0, 7.5, 8.0, 8.5, 9.0, 9.5, 10.0%, or any value therebetween.

Although frame 114 is depicted as a rectangular structure, any other structural configurations are contemplated herein.

Figure 2A:
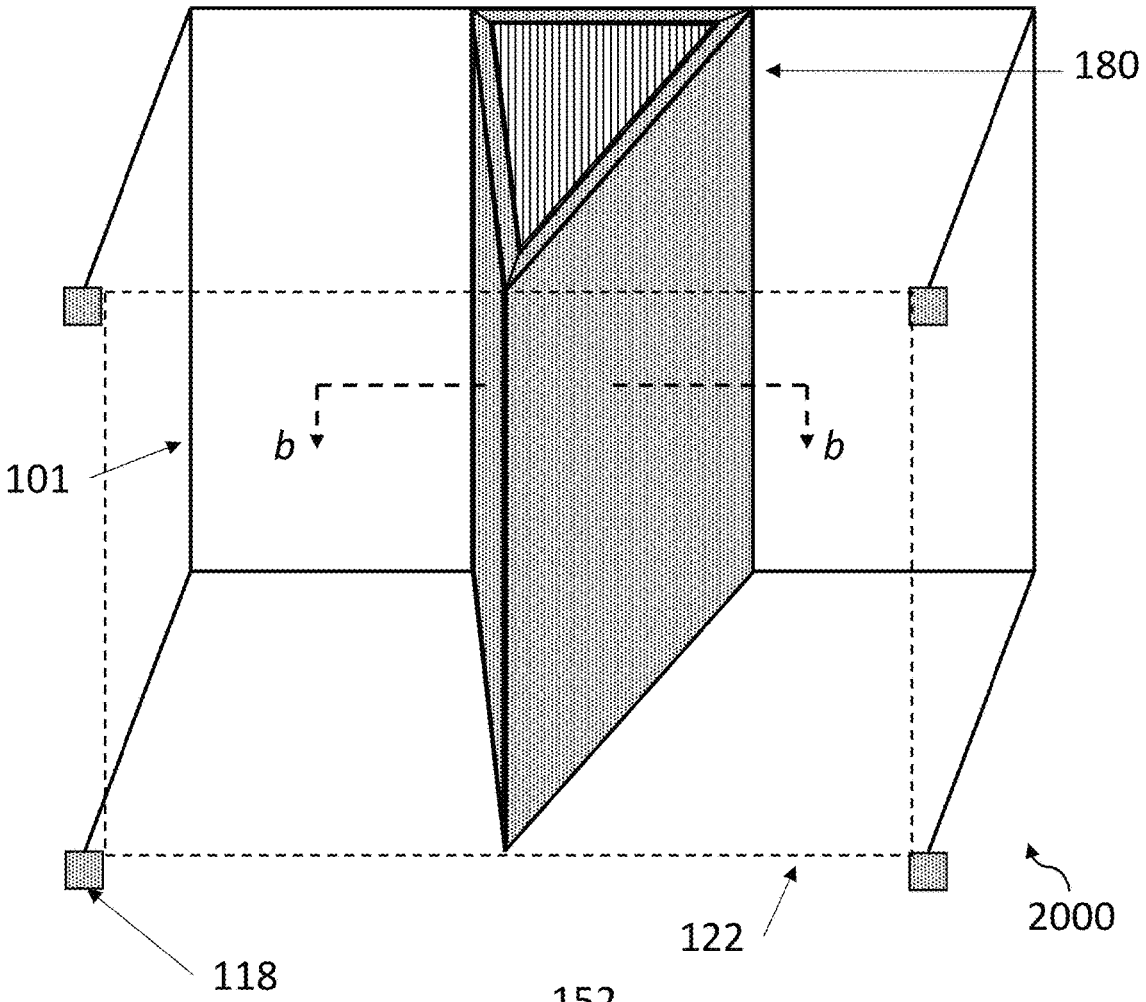
FIG. 2A is a frontal perspective view of an illustrative air guide assembly of the present disclosure wherein the body defines a cavity.
Figure 2B:
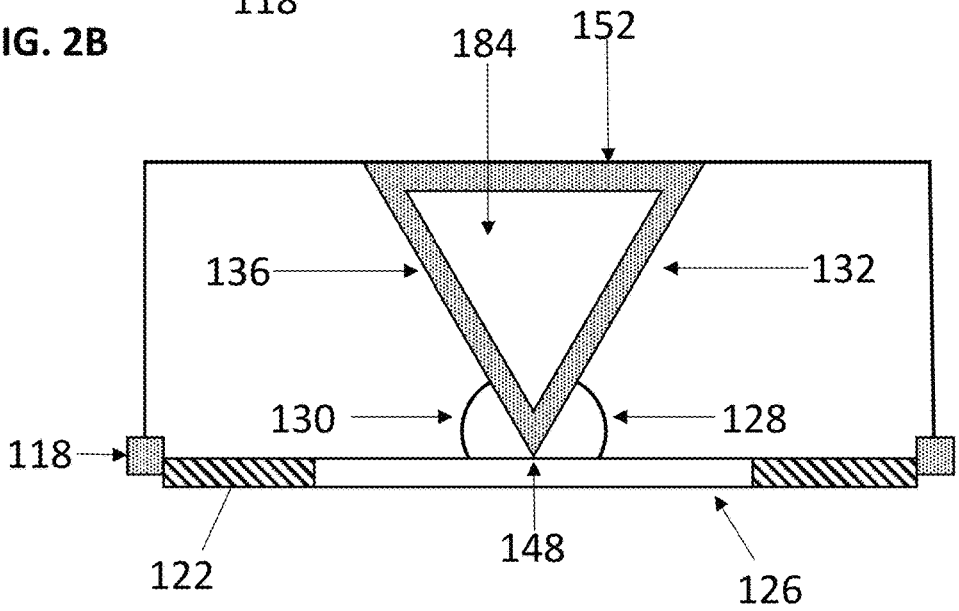
FIG. 2B shows a cross-section taken on the line b-b from FIG. 2A.

Referring to FIGS. 2A-2B, an illustrative air guide assembly 2000 is shown. that includes a body 180 defining a cavity 184. As described above frame 114 can be operatively coupled to the body to mount the body adjacent to building 122 and, in some configurations, the frame may include or be coupled to mounting device 118. Body 180 can be positioned adjacent to an opening 126, defined by the building 122, to increase the airflow into the opening. As described herein, body 180 can correspond to body 110 (or include one or more features of body 110) as described above in FIGS. 1A-1B and for brevity only notable differentiating features are described.

As depicted in the cross-section of body 180 shown in FIG. 2B, the body can have a triangular cross-sectional shape defining a cavity 184. Cavity 184 may be substantially equal in cross-sectional shape to the cross-sectional shape of body 180. Cavity 184 may be different in cross-sectional shape to the cross-sectional shape of body 180. Cavity 184 may have a cross-sectional shape comprising any polygonal (e.g., square, triangle, hexagon, etc.), circular, elliptical, or irregular shape. A body comprising a cavity can substantially reduce the weight of the air guide assembly facilitating handling, mounting, production, assembly, or distribution, than a body that does not define a cavity. In some aspects, the body does not define a cavity. A body that does not define a cavity may be more resistant to forces, e.g., air flow, and the elements, e.g., rain, snow, hail, etc.

Figure 3A:
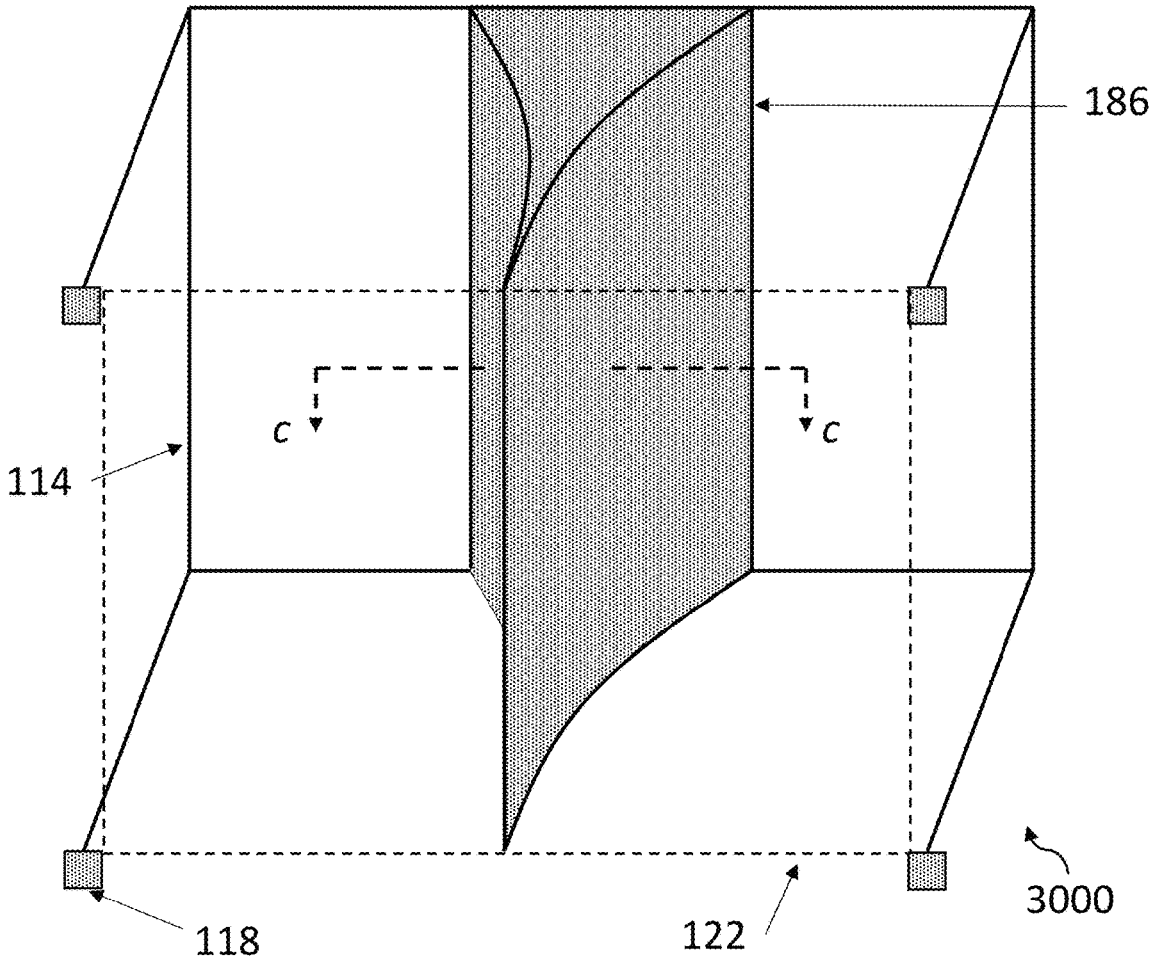
FIG. 3A is a frontal perspective view of an illustrative air guide assembly of the present disclosure wherein the body comprises a concave surface or side.
Figure 3B:
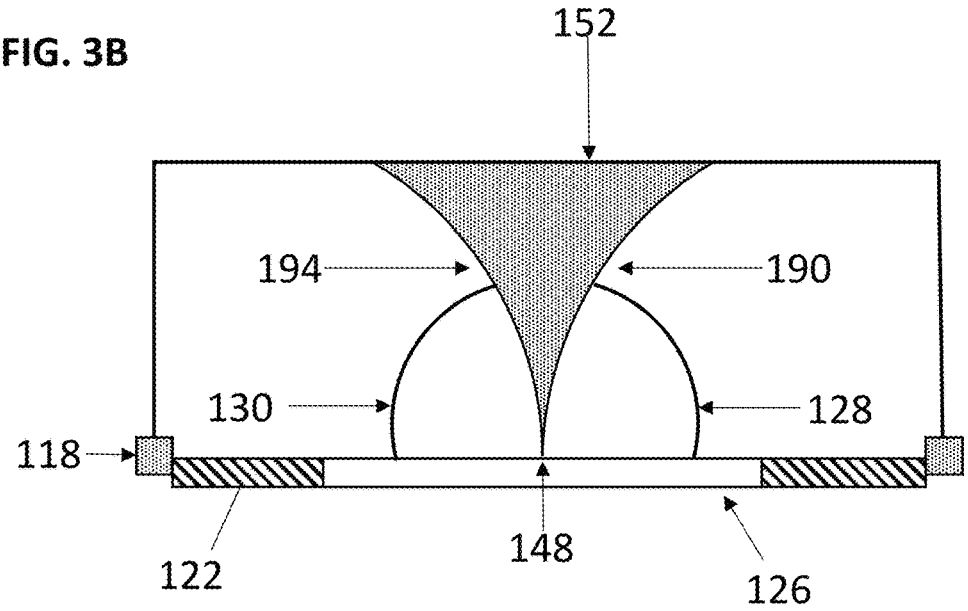
FIG. 3B shows a cross-section taken on the line c-c from FIG. 3A.

Referring to FIGS. 3A-3B, an illustrative air guide assembly 3000 is shown that includes a body 186, and a frame 114 as previously described. As described herein, body 180 can correspond to body 110 (or include one or more features of body 110) as described above in FIGS. 1A-1B and for brevity only notable differentiating features are described. As shown, body 186 can include one or more wind directing surfaces, such as a first surface 190 and a second surface 194 that are shaped to direct air into opening 126. As depicted in the cross-section of body 186 shown in FIG. 3B, the body can have a triangular cross-sectional shape with first surface 190 and a second surface 194 being concave surfaces. For example, first surface 190 or second surface 194 may have a concave surface extending from first end 148 to second end 152 of body 186. In other configurations, a wind directing surface (e.g., wind directing surface 190 and/or 194) can have a plurality of facets or sub-surfaces that are iteratively disposed, from first end 148 to second end 152, at decreasing angles. In an illustrative, non-limiting example, first surface 190 can include a plurality of sub-surfaces including: a first facet extending from first end 148 and angularly disposed to opening 126 at an angle of about 80 degrees, a second facet extending from the first facet toward second end 152 and disposed at and angle of about 45 degrees, and a third facet extending from the first facet toward second end 152 and disposed at and angle of about 15 degrees. Although this is just one example, it should be understood that other angles and number of sub-surfaces could be used. In some configurations, the wind directing surfaces can have between 1 and 20 sub-surfaces or facets. In some configurations, portions of first surface 190, a second surface 194, or both are angularly disposed relative to opening 126 at an angle 128 and 130, respectively, such that an air current is directed into opening 126. Angle 128 or 130 may be substantially greater or equal to 15 degrees, such as for example, 15, 20, 25, 30, 35, 40, 45, 50, 55, 60, 65, 70, 75, 80, 85 degrees, or any value therebetween.

Figure 4:
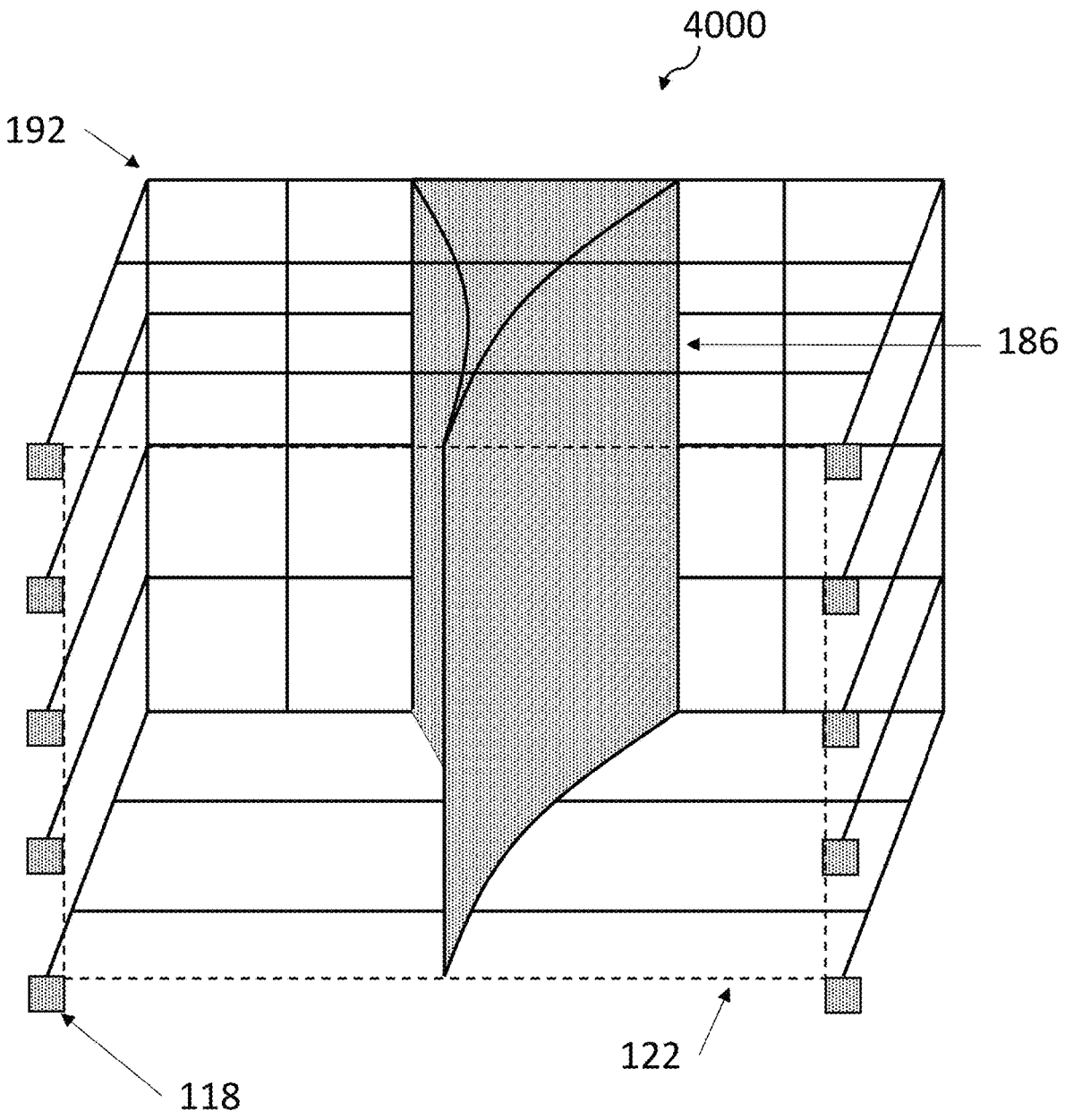
FIG. 4 is a frontal perspective view of an illustrative air guide assembly of the present disclosure wherein the frame comprises additional reinforcement.

Referring to FIG. 4, an illustrative air guide assembly 4000 is shown that includes a body 186 as previously described, merely as an example, but in no way limiting, and a frame 192, comprising reinforcements in a cage-like configuration, operatively coupled to body 186. Frame 192 is configured to mount body 186 adjacent to building 122, and in some configurations, the frame may include or be coupled to a mounting device 118 that may be attached directly or indirectly to building 122. In some configurations, frame 192 is operatively coupled to 1, 2, 3, 4, 5, 6, 7, 8, 9, 10 or more mounting devices 118. Frame 192 can be operatively coupled to a building so that body 186 can be positioned adjacent to an opening defined by building 122 to increase airflow into the opening.

As shown in FIG. 4, frame 192 may comprise 2 or more bars per side. Each bar can be operatively coupled at each end to the frame at a perpendicular angle, although the bars can also be operatively coupled to the frame at a different angle to the extent that the configuration of the bars creates a cage-like structure. A frame comprising a cage-like structure, such as frame 192, has the advantages of being able to support a heavier body than a frame with less or zero traverse bars; being able to provide protection against intruders while allowing an opening on building 122 to remain open for operation of the air guide assembly; and being able to be operatively coupled at points to building 122. A frame comprising a cage-like structure, such as frame 192, may comprise any element (e.g., body) of any other illustrative air guide assembly disclosed herein.

A frame comprising a structure, such as that of frame 192, for example, may comprise any element (e.g., body) of any other illustrative assembly disclosed herein.

Figure 5:
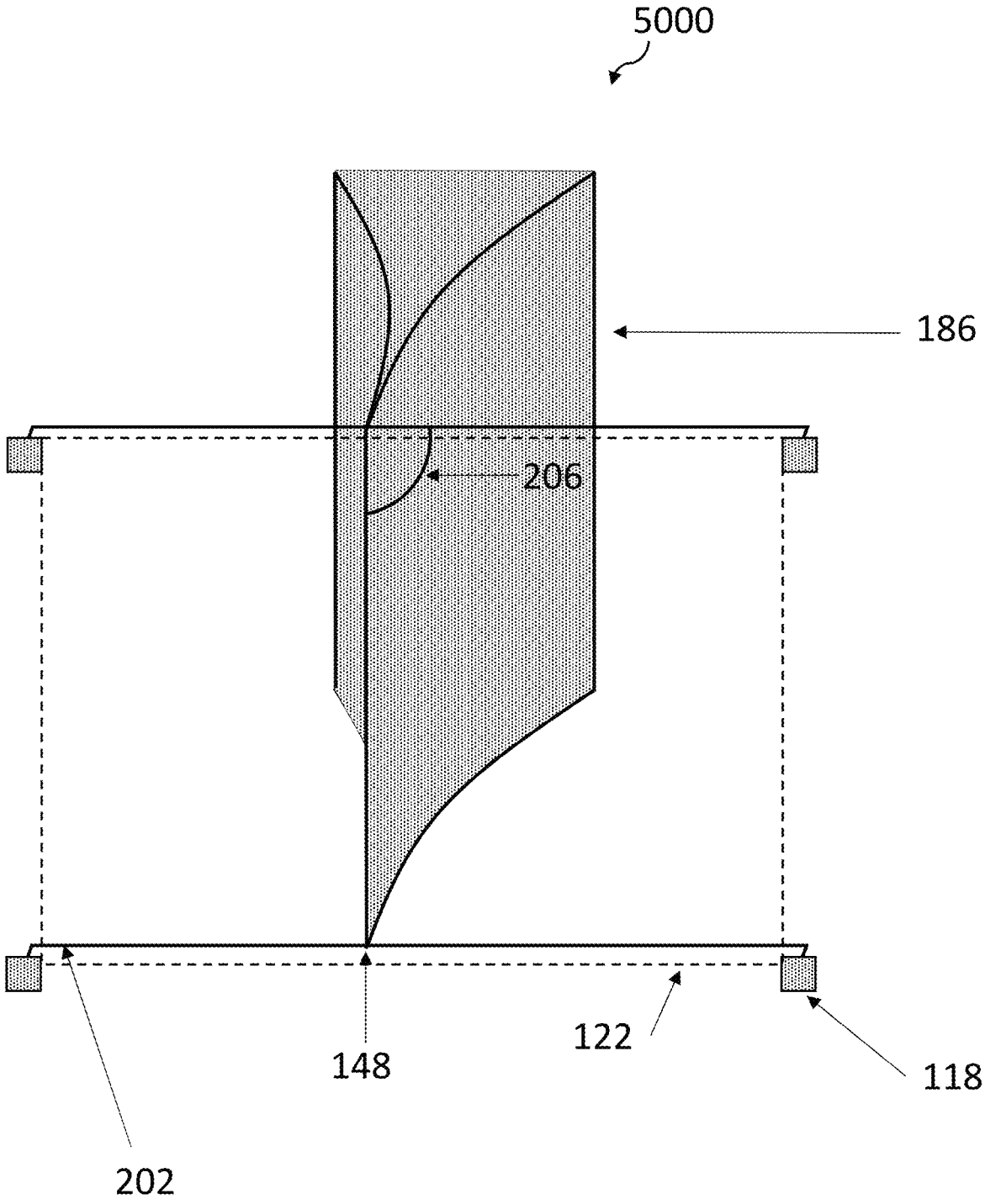
FIG. 5 is a frontal perspective view of an illustrative air guide assembly of the present disclosure comprising an alternative frame without a structure surrounding the body and without vertical supports between the top and bottom parts of the frame.

Referring to FIG. 5, an illustrative air guide assembly 5000 is shown that includes a body 186 as previously described, merely as an example, but in no way limiting, and a frame 202 lacking vertical reinforcements and lacking a structure enclosing the body. Frame 202 is configured to mount the body adjacent to a building 122 and, in some configurations, the frame may include or be coupled to a mounting device 118 that may be attached directly or indirectly to the building. Frame 202 can be coupled to building 122 so that the body can be positioned adjacent to an opening defined by building 122 to increase airflow into the opening.

Frame 202 may comprise a traverse bar operatively coupled to end 148 of body 186, for example, but any other body from any other assembly is contemplated. Frame 202 may comprise 1, 2, 3, 4, 5, 6, 7, 8, 9, 10 or more traverse bars operatively coupled to end 148 of body 186. Each bar may be disposed at an angle 206 that is substantially equal to 90 degrees. In some configurations, each bar of frame 202 can have a maximum length that is substantially greater than or equal to 0.3 m, such as for example, substantially 0.3, 0.5, 1.0, 1.5, 2.0, 2.5, 3.0, 3.5, 4.0 m, or any value therebetween. A frame with a traverse bar but lacking an enclosure, such as frame 202, has the advantages of being cheaper or to easier produce; easier to assemble; and depending on the number and placement of the bars relative to the opening, providing protection against intruders while allowing an opening on building 122 to remain open for allowing the air guide assembly to function as intended.

A frame comprising a structure, such as that of frame 202, for example, may comprise any element (e.g., body) of any other illustrative assembly disclosed herein.

Figure 6:
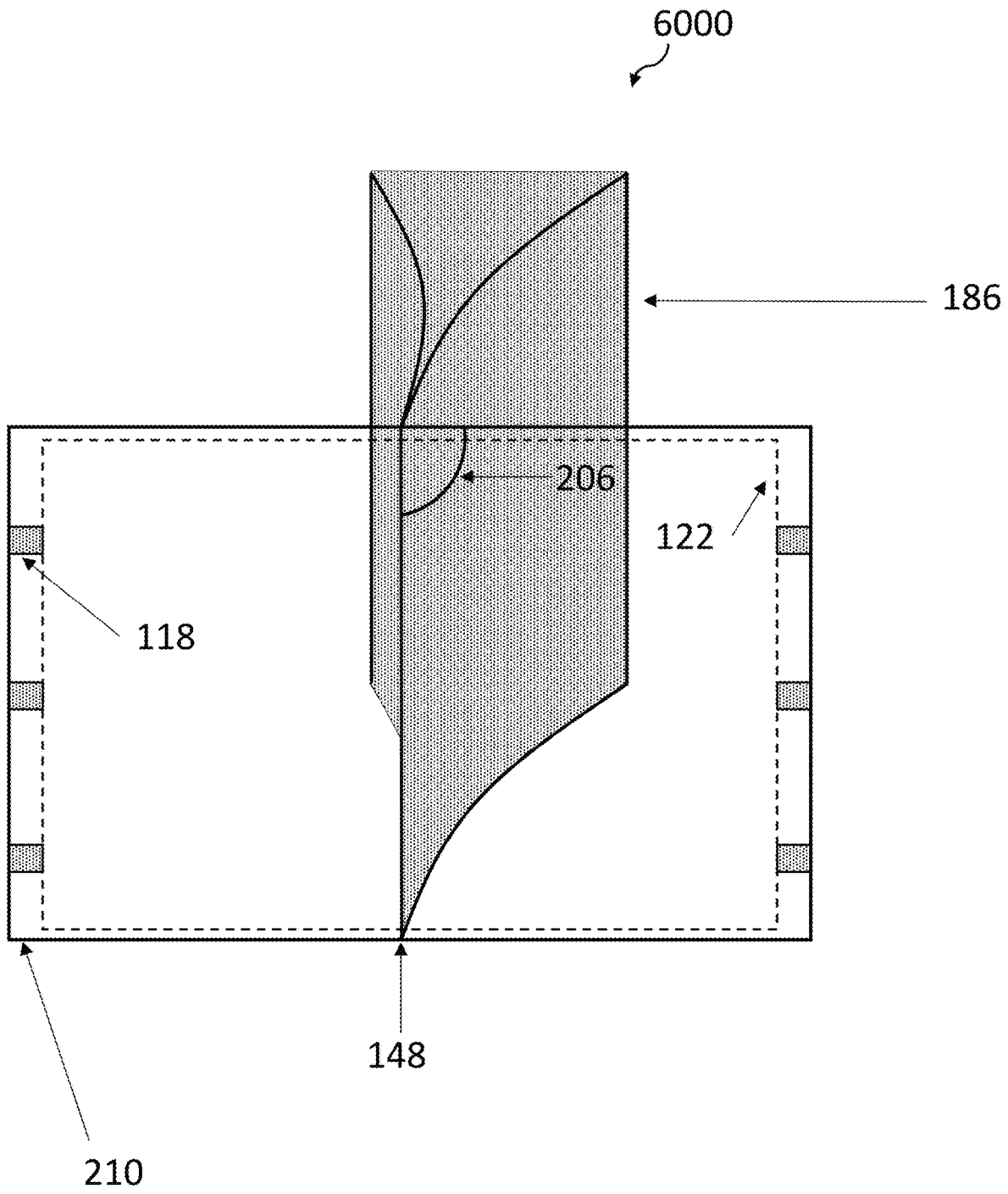
FIG. 6 is a frontal perspective view of an illustrative air guide assembly of the present disclosure comprising an alternative frame without a structure surrounding the body of the assembly.

Referring to FIG. 6, an illustrative air guide assembly 6000 is shown that includes a body 186 as previously described, merely as an example, but in no way limiting, and a frame 210 lacking a structure enclosing the body. Frame 210 is configured to mount body 186 adjacent to a building 122 and, in some configurations, the frame may be operatively coupled to a mounting device 118 that may be attached directly or indirectly to the building. Frame 210 can be coupled to building 122 so that body 186 can be positioned adjacent to an opening defined by the building 122 to increase the airflow into the opening.

Frame 210 can be operatively coupled to end 148 of body 186 as shown in FIG. 6. A frame lacking a structure enclosing the body, such as frame 210, has the advantages of being cheaper, easier to produce, or easier to assemble than a frame with a structure surrounding the body. In some configurations, frame 210 can have a height that is substantially greater than or equal to 0.3 m, such as for example, substantially 0.3, 0.5, 1.0, 1.5, 2.0, 2.5, 3.0, 3.5, 4.0 m, or any value therebetween. In some configurations, frame 210 can have a height that is equal to the height of body 186. As shown, the heigh of frame 210 is uniform, but in other configurations the height of frame 210 can vary (e.g., higher or lower at either end). In some configurations, frame 210 can have a maximum length that is substantially greater than or equal to 0.3 m, such as for example, substantially 0.3, 0.5, 1.0, 1.5, 2.0, 2.5, 3.0, 3.5, 4.0 m, or any value therebetween.

A frame comprising a structure, such as frame 210, may comprise any element (e.g., body) of any other illustrative assembly disclosed herein.

Figure 7:
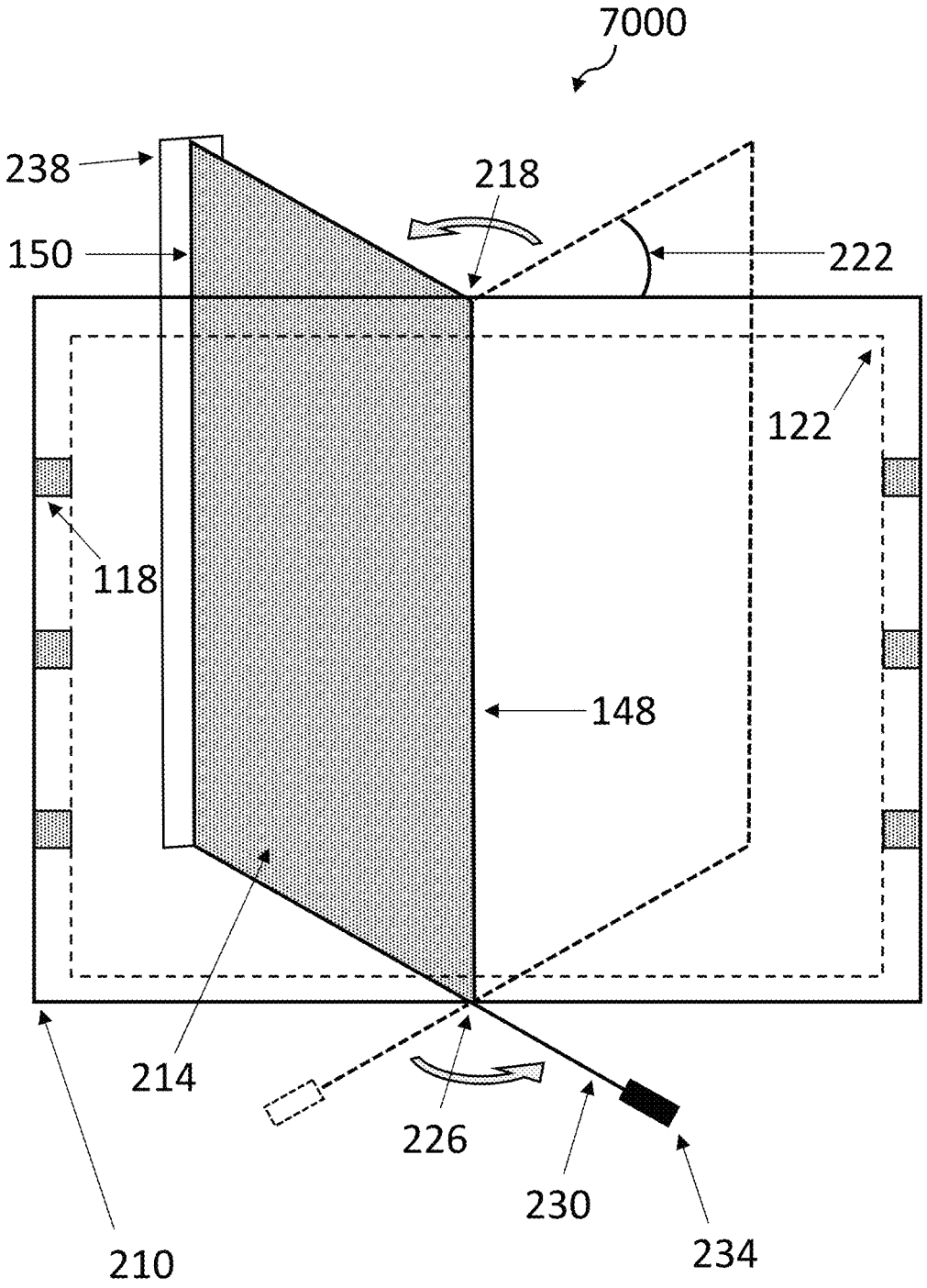
FIG. 7 is a frontal perspective view of an illustrative air guide assembly of the present disclosure comprising an articulation member configured for adjusting the position of the body.

Referring to FIG. 7, an illustrative air guide assembly 7000 is shown that includes a body 214, operatively coupled to a frame 210, merely as an example and in no way limiting. A frame, e.g., frame 210, can be configured to mount body 214 adjacent to an opening defined by building 122 and, in some configurations, the frame may include or be coupled to a mounting device 118 that may be attached directly or indirectly to the building. Although frame 210 is shown, any other frame of the disclosure is contemplated.

Body 214 includes a wind directing surface that is shaped to direct air into an opening defined by building 122. In some configurations, a surface of body 214 can have a height that is substantially greater than or equal to 0.3 m, such as for example, 0.3, 0.5, 1.0, 1.5, 2.0, 2.5, 3.0, 3.5, 4.0 m, or any value therebetween. In some configurations, a surface of the body 214 can have a width that is substantially greater than or equal to 10 cm, such as for example, 10, 15, 20, 25, 30, 35, 40, 45, 50, 55, 60, 65, 70, 75, 80, 85, 90, 95, 100 cm, or any value therebetween. In some configurations, a surface of the body 214 can have a surface area that is substantially greater than or equal to 0.3 $m^2$, such as for example, 0.3, 0.5, 1.0, 1.5, 2.0, 2.5, 3.0, 3.5, 4.0 $m^2$, or any value therebetween.

Assembly 7000, may further comprise an articulation member, e.g., a swivel or pivot, that operatively couples body 214 to frame 210, such as at first position 218 or second position 226. The articulation member, can allow the body to be disposed at a variable angle 222 relative to an opening defined by building 122, and at a variable distance from the opening, e.g., a distance defined by a first end 150 and first position 226. In some configurations, angle 222 can be substantially greater or equal to 15, 20, 25, 35, 40, 45, 50, 55, 60, 65, 70, 75, 80, 85, 90, 95, 100, 105, 110, 115, 120, 125, 130, 135, 140, 145, 150, 155, 160, 165, 170, 175 degrees, or any value therebetween. In some configurations, assembly 7000 further comprises a rod 230 operatively coupled to an articulation member of first position 226 and body 214, such that operation of the rod allows angle 222 and disposition of body 214 to be adjusted relative to the opening defined by building 122. In some configurations, an assembly further comprises a handle 234 operatively coupled to rod 230, such that operation of the rod is facilitated. In some configurations, rod 230, handle 234, or both can have a length that is substantially greater or equal to 0.3 m, such as for example, 0.3, 0.5, 1.0, 1.5, 2.0, 2.5, 3.0, 3.5, 4.0 m, or any value therebetween. In some configurations, the articulation member, such as a ball-bearing slide, swivel or both, at first positions 226, second position 218, or both allows body 214 to slide in and out of the opening for storage of body 214 inside the building.

In some configurations, body 214 can be operatively coupled to cover 238 that can cover a gap of the opening defined by building 122 when the body is stored inside the building. In some configurations, cover 238 can have a height that is substantially greater or equal to 0.3 m, such as for example, 0.3, 0.5, 1.0, 1.5, 2.0, 2.5, 3.0, 3.5, 4.0 m, or any value therebetween. In some configurations, cover 238, can have a width that is substantially greater or equal to 10 cm, such as for example, 10, 15, 20, 25, 30, 35, 40, 45, 50, 55, 60, 65, 70, 75, 80, 85, 90, 95, 100 cm, or any value therebetween. In some configurations, cover 238 can have a surface area that is substantially greater or equal to 0.3 $m^2$, such as for example, 0.3, 0.5, 1.0, 1.5, 2.0, 2.5, 3.0, 3.5, 4.0 $m^2$, or any value therebetween. In some configurations, an air-guide assembly does not comprise a cover.

An air-guide assembly, such as assembly 7000, for example, may comprise any element (e.g., frame) of any other illustrative assembly disclosed herein.

Figure 8:
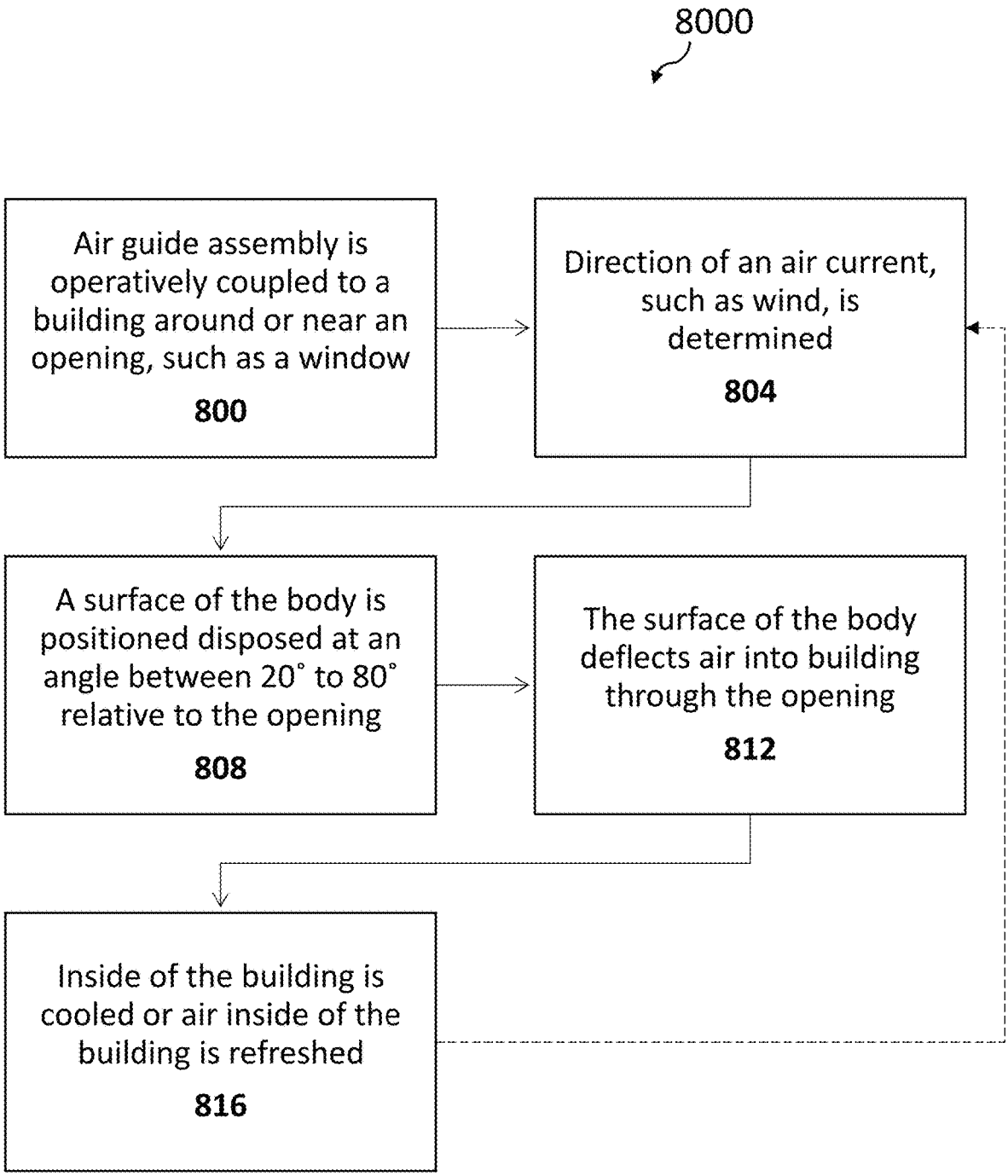
FIG. 8 is a flowchart of an illustrative method of cooling the inside of a building or refreshing the air inside a building using an air guide assembly of the present disclosure.

Referring now to FIG. 8, an illustrative method of cooling the inside of a building or refreshing the air inside of a building 8000 is shown. Method 8000 may be performed by illustrative assembly 1000, 2000, 3000, 4000, 5000, 6000, or 7000, as non-limiting examples, or any other assembly contemplated or disclosed herein. At first step, 800 an air guide assembly of the disclosure is operatively coupled to an opening defined by a building. The opening may be a window or a door, for example. At step 804, the direction of an air current, such as wind, is determined. At step 808, a wind-directing surface of the air guide assembly is positioned at angle suitable to deflect the air current into the opening defined by the building. The surface of the body may be disposed at an angle, relative to the opening, substantially greater or equal to 15 degrees, such as for example, 15, 20, 25, 30, 35, 40, 45, 50, 55, 60, 65, 70, 75, 80 degrees, or any value therebetween. At step 812, the surface of the body deflects air into the building. At step 816, the inside of the building is cooled or air inside the building is refreshed. In some aspects, a method further comprises reassessing the direction of the air current and repositioning a surface of the body at a new angle to deflect an air current into the opening (dashed line).

An air guide assembly of the disclosure may comprise a mounting device for operatively coupling the assembly, such as a frame or a body of the disclosure to a building. A mounting device may be operatively coupled to a frame, body, or both of the disclosure. A mounting device may comprise any device suitable for supporting the weight of an assembly of the disclosure. A mounting device may comprise any device suitable for operatively coupling an air guide assembly of the disclosure around, near, or at an opening defined by a building, such as a door or a window, in such a way for deflecting an air current into the opening. As an illustrative, non-limiting example, a mounting device may comprise a hook, mounting plate, bracket, screw, nut, nail, or a combination thereof.

An air guide assembly of the disclosure or any of its parts (e.g., body, frame, rod, mounting device, handle, articulation member, or cover) may comprise any suitable rigid material that can withstand or deflect an air current (e.g., an air current of about 5 miles per hour (MPH) to about 60 MPH), including but not limited to, a metal (e.g., steel, stainless steel, titanium alloys, aluminum, brass, bronze, chrome, pewter, cast iron, silver, corrosion resistant alloys, or the like), a polymer (e.g., plastic), a composite (e.g., fiberglass, cardboard, etc.), a wood (e.g., plywood), a glass, or a combination thereof. In some aspects, the material is weather resistant (e.g., moisture repellent, UV resistant, etc.). In some aspects, the body is coated with a material, such as epoxy or polyurethane, to protect it from deterioration (e.g., tarnishing, oxidation, rust, corrosion, etc.). The assembly or any of its parts may be produced in any suitable way, such as casting, molding, 3D-printing, carving, thermoforming, forging, machining, stamping, electroforming, powder metallurgy, extrusion, or a combination thereof. It is contemplate that any or all parts of the assembly may be translucent. A translucent body, for example, can be placed at an optimal position for deflecting an air current into a building without substantially obstruction vision.

In certain aspects, the body, frame, mounting device, rod, handle, cover, or articulation member is operatively coupled to one another in any suitable combination. As illustrative, non-limiting, examples, a body of the disclosure may be operatively coupled to a frame; a body of the disclosure may be operatively coupled to an articulation member; a body of the disclosure may be operatively coupled to a mounting device; a body of the disclosure may be operatively coupled to a cover; a frame of the disclosure may be operatively coupled to a mounting device; a frame of the disclosure may be operatively coupled to an articulation member; a frame of the disclosure may be operatively coupled to a rod; a frame of the disclosure may be operatively coupled to a body; a rod of the disclosure may be operatively coupled to a rod; a rod of the disclosure may be operatively coupled to a frame; a rod of the disclosure may be operatively coupled to a body; a rod of the disclosure may be operatively coupled to a handle; a rod of the disclosure may be operatively coupled to an articulation member; or a combination thereof. The assembly may be designed for its parts to be operatively coupled in a way that facilitates assembly or disassembly. As an illustrative, non-limiting example, two or more parts of an air guide assembly of the disclosure may be operatively coupled by a screw, nut, hinge, clip, draw-latch, push-type retainer, barb clip, rivet, staple, joint, or a combination thereof. Two or more parts of an air guide assembly of the disclosure may be operatively coupled in a way that improves stability. As an illustrative, non-limiting example, two or more parts of an air guide assembly of the disclosure may be operatively coupled by adhesive, soldering or brazing, welding, or a combination thereof.

In certain aspects, an assembly of the disclosure is operatively coupled to a building. In certain aspects, the assembly may be operatively coupled around, near, or adjacent to an opening defined by a building. The opening may be of any shape or size and the assembly may be of a suitable or corresponding shape or size. In some aspects, the assembly is larger in height, length, width, or area than the opening. In some aspects, the assembly is smaller in height, length, width, or area than the opening. In some aspects, the opening is a window, door, vent, etc. In some aspects, the assembly is operatively coupled on the outside of the building. In some aspects the building is a house, apartment, condominium, townhouse, duplex, office building, retail building, shopping mall, hotel, restaurant, factory, warehouse, distribution center, school, hospital, library, museum, airport, train station, bus station, theater, community center, etc.

All of the assemblies and methods disclosed and claimed herein can be made and executed without undue experimentation in light of the present disclosure. While the assemblies and methods of this disclosure have been described in terms of illustrative embodiments, it will be apparent to those of skill in the art that variations may be applied to the assemblies and methods and in the steps or in the sequence of steps of the methods described herein without departing from the concept, spirit and scope of the disclosure. More specifically, it will be apparent that certain material or parts may be substituted for those described herein while the same or similar results would be achieved. All such similar substitutes and modifications apparent to those skilled in the art are deemed to be within the spirit, scope and concept of the disclosure as defined by the appended claims.

What is claimed is:

1. An air guide assembly, the assembly comprising:

a frame configured to be disposed adjacent to an opening of a building;

a body operatively coupled to the frame, the body having a surface configured to deflect an air current into the opening while the frame is operatively coupled to the building, wherein the surface of the body is angularly disposed relative to the opening at an angle between about 20° to 80°; and an articulation member configured to move the surface of the body relative to the opening to adjust the angle, wherein the articulation member comprises a ball-bearing slide configured to allow the body to slide in and out of the opening.

2. The assembly of claim 1, wherein the angle is about 45°.

3. The assembly of claim 1, wherein the body comprises plastic, metal, or glass.

4. The assembly of claim 1, wherein the body is translucent.

5. The assembly of claim 1, wherein the body comprises a concave side.

6. The assembly of claim 1, wherein the frame further comprises a mounting device configured to operatively couple the frame to the building.

7. The assembly of claim 1, wherein the body defines a cavity.

8. The assembly of claim 1, wherein a horizontal cross-section of the body has a polygonal, pyriform, or oval shape.

9. The assembly of claim 1, further comprising a rod operatively coupled to the articulation member configured to facilitate adjustment of the angle, and optionally a handle operatively coupled to the rod.

10. The assembly of claim 1, wherein the body further comprises a cover operatively coupled to an end opposite to the opening.

* * * * *